United States Patent [19]

Riehemann

[11] Patent Number: 5,050,552

[45] Date of Patent: Sep. 24, 1991

[54] SYSTEM FOR ELECTRONICALLY CONTROLLING THE POWER OF AN INTERNAL COMBUSTION ENGINE OF A MOTOR VEHICLE

[75] Inventor: Thomas Riehemann, Bühlertal, Fed. Rep. of Germany

[73] Assignee: Robert Bosch GmbH, Stuttgart, Fed. Rep. of Germany

[21] Appl. No.: 559,349

[22] Filed: Jul. 30, 1990

Related U.S. Application Data

[63] Continuation-in-part of Ser. No. 1,082, Nov. 29, 1988.

[30] Foreign Application Priority Data

Nov. 18, 1989 [DE] Fed. Rep. of Germany ..... 3938378

[51] Int. Cl.[5] ..... F02D 41/22

[52] U.S. Cl. ..... 123/361; 123/399

[58] Field of Search ..... 123/361, 399, 479, 359, 123/198 D

[56] References Cited

U.S. PATENT DOCUMENTS 4,519,360 5/1985 Murakami ..... 123/399
4,881,502 11/1989 Kabasin ..... 123/479 X
4,919,097 4/1990 Mitui et al. ..... 123/399

*Primary Examiner*—Tony M. Argenbright
*Attorney, Agent, or Firm*—Walter Ottesen

[57] ABSTRACT

The invention is directed to a system for electronically open-loop controlling or closed-loop controlling the power of an internal combustion engine of a motor vehicle with an electrically actuable actuator influencing the engine power. The adjustment of this actuator is undertaken in dependence on a predetermined and an actual value for producing a match between pregiven and actual values. With the disappearance of a previously detected electrical disturbance of the system, the function is again taken up in a delayed manner.

12 Claims, 2 Drawing Sheets

SYSTEM FOR ELECTRONICALLY CONTROLLING THE POWER OF AN INTERNAL COMBUSTION ENGINE OF A MOTOR VEHICLE

RELATED APPLICATION

This application is a continuation-in-part application of International patent application PCT/EP88/01082 filed on Nov. 29, 1988 in the European Patent Office. In addition, priority is claimed from German patent application P 39 38 378.4 filed on Nov. 18, 1989.

FIELD OF THE INVENTION

The invention relates to a system for electronically controlling the power of an internal combustion engine of a motor vehicle with the system including an electrically actuable actuator which influences engine power. The actuator is adjusted in dependence upon a pregiven and an actual value for producing a match between predetermined and actual values.

BACKGROUND OF THE INVENTION

U.S. Pat. No. 4,519,360 is related to the area of the electronic control of an internal combustion engine of a motor vehicle and discloses a throttle flap in the intake pipe system of the engine which is actuated by an actuator responding to an electrical control signal. The control signal is derived from the position of the accelerator pedal. Potentiometers connected to the accelerator pedal and the throttle flap supply a desired value signal and an actual value feedback signal. The actuating signals for the actuator are obtained from a comparison of these signals.

The throttle flap is biased by a spring in the direction toward its idle position or a pregiven closed position for reasons of safety. For this reason, each function interruption of the actuator during normal operation of the engine leads to a movement of the throttle flap in the direction of its idle position or closed position during the normal operation of the engine. This causes the output power of the engine to be reduced. It is the driver's direct reaction to depress the accelerator pedal when noticing this loss in power. The interruption can be of a short duration such as in the case of a loose contact in the electrical circuit of the actuator. If this is the case, then the actuator directs the throttle flap quickly into a new position as soon as it is again functional with this new position corresponding to the new position of the accelerator pedal. In this way, an undesired increase of the engine output power occurs greater than the one originally wanted by the driver. This can be a source of danger since the driver is not prepared for an increase in the engine output power especially if the driver is surprised thereby.

SUMMARY OF THE INVENTION

It is an object of the invention to avoid such driving situations which are critical to safety when an electrical disturbance is detected. A delayed resumption of the system function after a previously detected electrical disturbance disappears assures that the system can be reintroduced in a manner uncritical to safety. The resumption of the system function follows for example a predetermined time function and the disturbance could cause a situation of the kind described above.

Each interruption of the normal function of the actuator during normal operation of the engine can be recognized by the falling actual value signal corresponding to the idle position or predetermined closed position of the throttle flap when the desired value signal remains constant or increases; that is, without a reduction in the desired value signal. The actuator quickly and directly moves the throttle flap into the position corresponding to the desired value signal when the actuator is again in function. This desired value can be greater than the value which was present in advance of the interruption of the function of the actuator in the event that the driver in addition depressed the accelerator pedal further. A sudden rapid increase of the engine output power can be the result. The throttle flap is however moved into this position in a delayed manner according to a predetermined time function.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
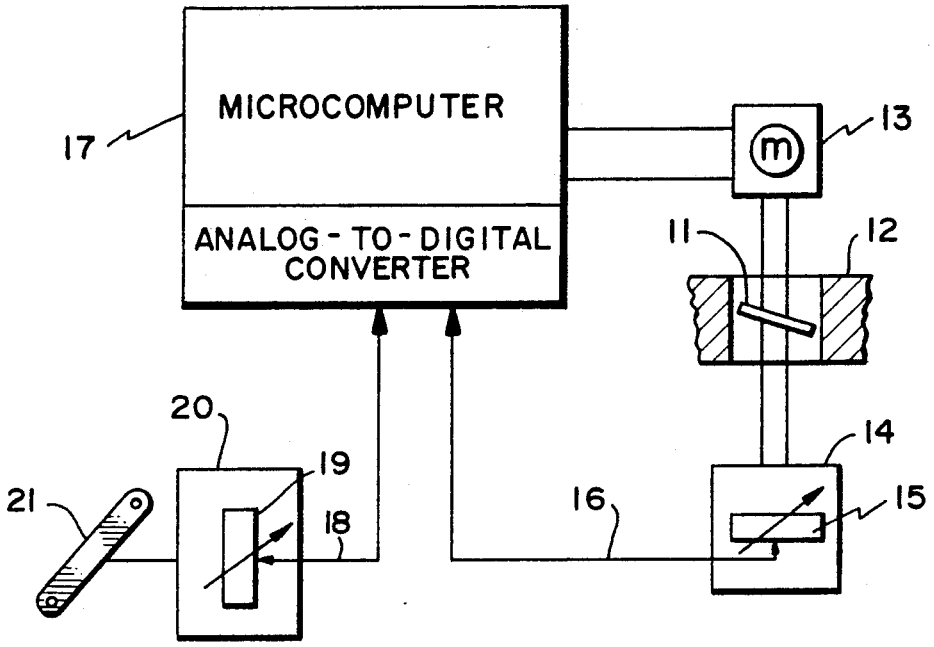
FIG. 1 is a schematic of the system of the invention for electronically open-loop and/or closed-loop controlling the power of an internal combustion engine of a motor vehicle according to one embodiment of the invention.

FIG. 1 first shows a throttle flap 11 disposed in the air intake system 12 of an engine (not illustrated) which is actuated by the actuator 13. A sensor 40 in the form of a potentiometer 15 provides a feedback signal on the line 16 to the microcomputer 17. The microcomputer 17 receives a desired value signal from a potentiometer 19 via the line 18. The potentiometer 19 defines a sensor which responds to the position of an accelerator pedal 21. The throttle flap 11 is tensioned by a spring in the direction of its idle position or predetermined closed position for reasons of safety and defines a position member which is actuated by actuator 13 in dependence upon the control signal derived from depressing the accelerator pedal 21.

A system of this kind can also be of analog configuration. In this case, the desired value taken from the accelerator pedal is compared in an analog comparison unit with the actual value representing the position of the throttle flap and the comparison result is processed in a position controller for driving the actuator 13. The position controller is configured with analog circuit elements. On the other hand, and if required, the above-mentioned desired value taken from the accelerator pedal 21 can be processed digitally.

Figure 2:
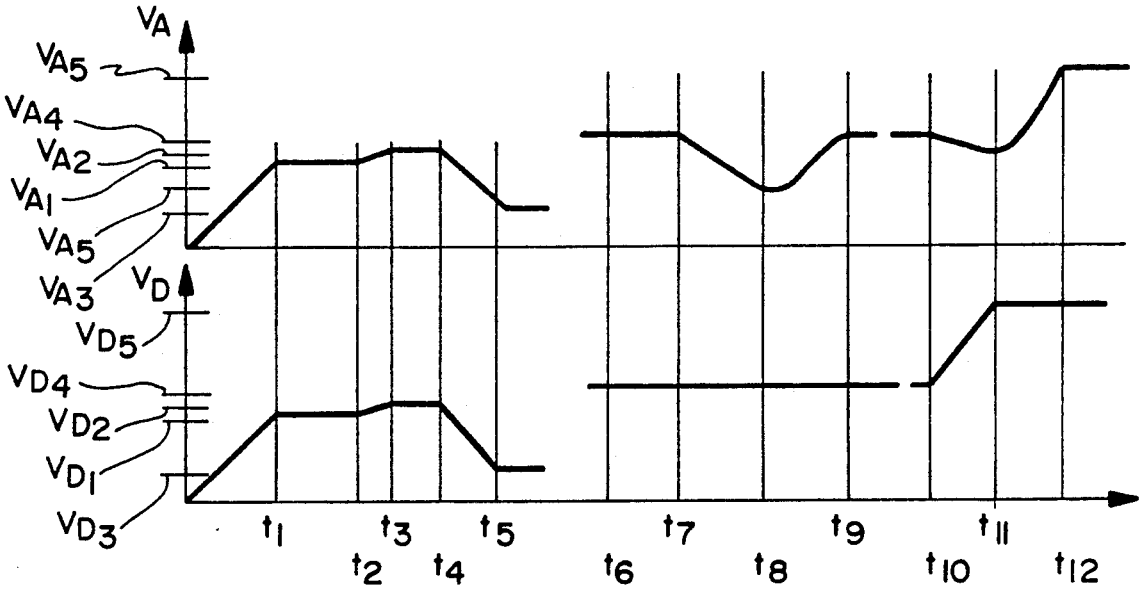
FIG. 2 is a graphic representation of the conditions which can occur during the operation of the system of FIG. 1; and, FIG. 3 is a flowchart which illustrates the function of the microcomputer of the system shown in FIG. 1.

The accelerator pedal is actuated in normal operating conditions and a desired value signal on the line 18 is compared with an actual value signal on the line 16 and corresponding actuating signals are transmitted to the actuator 13 until the throttle flap is in such a position that the actual value feedback signal on line 16 corresponds to the desired value signal. The changes in the desired value signal are rapidly followed by the movement of the throttle flap 11 even though an insignificant time delay is present before the throttle flap 11 actually reaches the desired position. Such a normal operating performance is illustrated graphically in the example on the left-hand side of FIG. 2 wherein the horizontal axis represents the time and the vertical axis represents the desired and actual value signals as voltage values. The symbol $V_D$ designates the desired value signal while the symbol $V_A$ designates the actual value signal. The desired value signal increases to the value $V_{D1}$ at time $t_1$ upon the initial actuation of the accelerator pedal 21 and the desired value signal increases to the corresponding value $V_{A1}$ with an insignificant time delay. The desired value increases, after it has remained constant at the voltage value $V_{D1}$ up to the time $t_2$, to the value $V_{D2}$ at time $t_3$ and remains constant until time $t_4$ and then decreases to the value $V_{D3}$ at time $t_5$. The actual value signal follows after $V_{A2}$ at a time point which lies just after the time $t_3$ and drops to $V_{A3}$ at a time point which lies just after time $t_5$. During this normal operation, the insignificant deviation between the desired value signal $V_D$ and the actual value signal $V_A$, occurring from time to time, is of no consequence and is within the normal operating tolerance.

The throttle flap 11 moves in the direction of its idle position or predetermined closed position when, for example, the function of the actuator 13 is interrupted. This is illustrated in the center portion of FIG. 2 for which it is assumed that the desired value signal, for example, remains constant at $V_{D4}$ from time point $t_6$ to time point $t_{10}$. In contrast, the actual value signal $V_A$ is at $V_{A4}$ at time point $t_6$ and at time point $t_7$, the function of the actuator 13 is interrupted; and, since the throttle flap 11 moves in the direction toward its idle position or pregiven closed position, the actual value signal drops and reaches the value $V_{A5}$ at time point $t_8$. Assuming that the function of the actuator 13 is again restored at this time point $t_8$, then the actuator 13 directly and immediately would move the throttle flap 11 in such a manner to a position during normal operating performance that the actual value signal increases very rapidly to the value $V_{A4}$. This produces the effect that a sudden increase of the motor output power is generated which follows upon a relatively slow drop in engine output power. In addition, the direct and instinctive reaction of the driver would be to further depress the accelerator pedal when he recognizes a drop of this kind in the engine output power. This circumstance would give cause to rapidly increase the engine output capacity to a value which is greater than that desired by the driver. The system of the invention avoids this difficulty since the microcomputer 17 operates in such a manner that the actuating signals of the actuator 13 are so configured that the throttle flap moves with a time delay into the appropriate position at time point $t_9$ as graphically shown in FIG. 2.

A faulty function of the throttle flap 11 during control by the actuator 13 can also take on the form wherein the actual value signal and the desired value signal move in mutually opposite directions; for example, the driver can press the accelerator pedal in order to generate an increase of the desired value signal while the throttle flap moves in the opposite direction and a dropping actual position signal is produced. This too can be detected and is illustrated in the right-hand side of FIG. 2. At time point $t_{10}$, the desired value signal $V_D$ increases from $V_{D4}$ to $V_{D5}$ at time point $t_{11}$ while the actual value signal $V_A$ drops from $V_{A4}$ at time point $t_{10}$ to a lower value at time point $t_{11}$. This can be assumed as a result of a function interruption of the actuator 13 which becomes operational once again at time point $t_{11}$. The actuator 13 then does not directly and very rapidly move the throttle flap into the position which corresponds to the desired value signal $V_{D5}$; instead, the actuator 13 moves the throttle flap 11 in a time-delayed manner so that the actual value signal $V_A$ reaches the corresponding value $V_{A5}$ at time point $t_{12}$.

Figure 3:
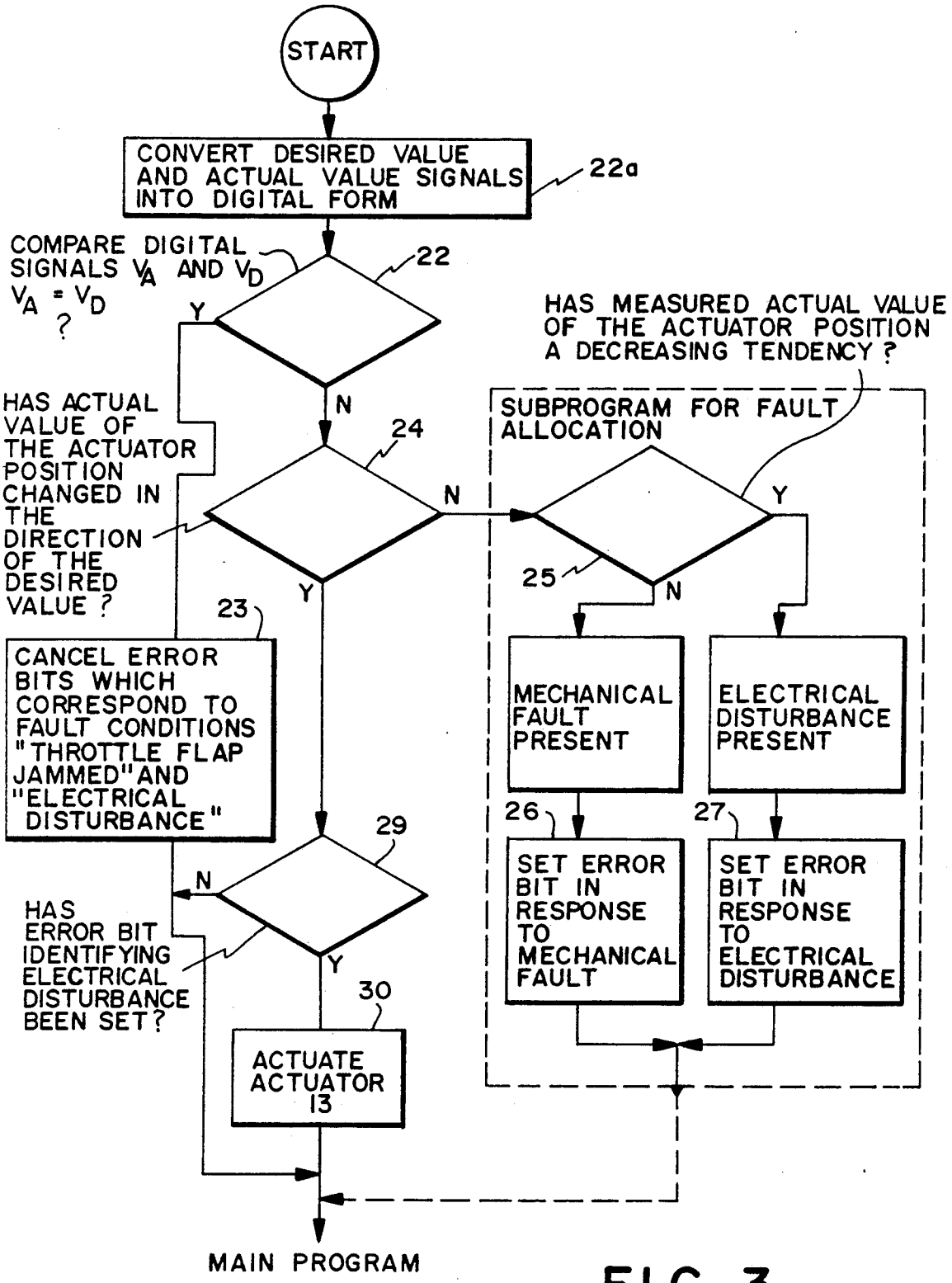

The manner in which the microcomputer 17 operates can be described with reference to the flowchart of FIG. 3. The desired value and actual value signals are converted at 22a from an analog into a digital form for further processing and the digital signals $V_A$ and $V_D$ are compared to each other at 22. If these signals match each other within a time frame dependent upon the adjusting time of the actuator 13 and the throttle flap, the error bits in 23 are cancelled which correspond to the fault condition "throttle flap jammed" and "electrical disturbance". It should be noted that during normal operating conditions, these error bits are not set and the main program then continues in a normal manner.

However, when the desired and actual values do not match within the adjusting time, an inquiry is carried out in 24 as to whether the actual value of the actuator position has changed in the direction of the predetermined value (desired value). If this is not the case, then a subprogram for fault allocation is initiated and an inquiry is carried out in 25 as to whether the measured actual value of the actuator position has a decreasing tendency. This situation characterizes an electrical disturbance which leads to a movement of the actuator in a direction toward its idle or predetermined closed position even though the predetermined value increases or remains constant. An example of such an error condition is an interruption in the area of the drive of the actuator. This fault condition is indicated by setting the fault bit in 27 which indicates such an electrical disturbance.

If no falling tendency of the actual value signal is detected in the inquiry in 25, then a mechanical fault such as a jamming of the actuating member is indicated by approximately constant actuator position with increasing or falling predetermined desired value. The corresponding fault bit is set in 26. In addition, the possibility is provided of initiating an emergency operation in the case of a fault and this possibility is indicated in blocks 26 and 27.

In this connection, the possibility is provided of detecting a fault in the microcomputer or a short circuit in the area of the drive of the actuator from an increasing actual value with a constant or decreasing tendency in the pregiven value. Faults of this kind lead in the state of the art to the introduction of an emergency function which effects a return of the actuator into its rest position and thereby indicates the characteristic of the first-mentioned fault condition.

The actual value of the actuator position can move in a direction toward the predetermined value and if this actual value is detected in inquiry block 24, then two reasons can be offered for such a performance. One reason is that the possibility exists that the actual value has not yet reached the pregiven value because of the adjusting time of the actuator. A second reason is that the actual value of the actuator position can begin to follow the pregiven value in the case of an electrical disturbance such as the function interruption of the actuator 13. This second condition can then be detected since in the previous program run-through(s) at the occurrence, for example, of a function interruption of the actuator, the fault bit which identifies the electrical disturbance was set according to the invention in 27.

This inquiry is made in 29 and if this fault bit is set, the actuator 13 is actuated in correspondence with block 30 so that the actual value signal $V_A$ and therefore the actuator position is brought in a delayed manner to the predetermined value. For example, the drive signal influencing the actuator position, after disappearance of the fault condition, is brought to a value determined by the computer pursuant to a time-dependent pregiven function. A further realization possibility can be seen in a filter (for example a low pass filter) which, activated, delays the control signal after the disappearance of the fault condition. In this way, the initially mentioned critical driving condition is effectively avoided and an overshoot of the control system after resuming its function with the disappearance of an electrical disturbance detected previously is prevented.

It is understood that the foregoing description is that of the preferred embodiments of the invention and that various changes and modifications may be made thereto without departing from the spirit and scope of the invention as defined in the appended claims.

What is claimed is:

1. A system for electronically controlling the power of an internal combustion engine of a motor vehicle, the system comprising:

an electrically actuable actuator for influencing the power of the engine;

adjusting means for adjusting said actuator in dependence upon a pregiven value and an actual value for producing a match between said values;

checking means for checking a change of the pregiven value and the actual value of the position of the actuator;

derivation means for deriving the presence and discontinuance of an electrical fault from said change; and, means for resuming the function of said system in a delayed manner after the discontinuance of a previously detected electrical fault of the system.

2. The system of claim 1, wherein an electrical interruption in the drive circuit is detected from an actuator moving in the direction of its closed position and from a desired value which undergoes a change in a manner which is not the same.

3. The system of claim 1, wherein the control is established in such a manner, after discontinuance of a previously detected fault condition, that the actuator position is controlled to a position pregiven by the control system pursuant to a pregiven time function.

4. The system of claim 1, wherein with the discontinuance of a previously detected electrical fault, when the position of the actuator begins to follow the pregiven value, the drive signal for the actuator is pregiven such that the position of the actuator approaches the pregiven desired value in a time-delayed manner.

5. A system for electronically controlling the power of an internal combustion engine of a motor vehicle, the system comprising:

an electrically actuable actuator for influencing the power of the engine;

adjusting means for adjusting said actuator in dependence upon a pregiven value and an actual value for producing a match between said values;

checking means for checking a change of the pregiven value and the actual value of the position of the actuator;

derivation means for deriving the presence of an electrical fault from said change; and, means for resuming the function of said system in a delayed manner after the discontinuance of a previously detected electrical fault of the system.

6. The system of claim 5, wherein an electrical interruption in the drive circuit is detected from an actuator moving in the direction of its closed position and from a desired value which undergoes a change in a manner which is not the same.

7. The system of claim 5, wherein the control is established in such a manner, after discontinuance of a previously detected fault condition, that the actuator position is controlled to a position pregiven by the control system pursuant to a pregiven time function.

8. The system of claim 5, wherein with the discontinuance of a previously detected electrical fault, when the position of the actuator begins to follow the pregiven value, the drive signal for the actuator is pregiven such that the position of the actuator approaches the pregiven desired value in a time-delayed manner.

9. A system for electronically controlling the power of an internal combustion engine of a motor vehicle, the system comprising:

an electrically actuable actuator for influencing the power of the engine;

adjusting means for adjusting said actuator in dependence upon a pregiven value and an actual value for producing a match between said values;

checking means for checking a change of the pregiven value and the actual value of the position of the actuator;

derivation means for deriving the presence of an electrical fault from said change; and, means for resuming the function of said system in a delayed manner after the discontinuance of a previously detected electrical fault of the system.

10. The system of claim 9, wherein an electrical interruption in the drive circuit is detected from an actuator moving in the direction of its closed position and from a desired value which undergoes a change in a manner which is not the same.

11. The system of claim 9, wherein the control is established in such a manner, after discontinuance of a previously detected fault condition, that the actuator position is controlled to a position pregiven by the control system pursuant to a pregiven time function.

12. The system of claim 9, wherein the discontinuance of a previously detected electrical fault, when the position of the actuator begins to follow the pregiven value, the drive signal for the actuator is pregiven such that the position of the actuator approaches the pregiven desired value in a time-delayed manner.

* * * * *

UNITED STATES PATENT AND TRADEMARK OFFICE

CERTIFICATE OF CORRECTION

PATENT NO. : 5,050,552

DATED : September 24, 1991

INVENTOR(S) : Thomas Riehemann

It is certified that error appears in the above-identified patent and that said Letters Patent is hereby corrected as shown below:

On the title page, under "Related U.S. Application Data", reference numeral [63]: delete "Ser. No. 1,082" and substitute -- PCT/EP88/01082 -- therefor.

In column 6, line 39: delete "presence" and substitute -- discontinuance -- therefor.

In column 6, line 54, between "wherein" and "the", insert -- with --.

Signed and Sealed this

Eighteenth Day of May, 1993

*Attest:*

Michael K. Kirk

MICHAEL K. KIRK

*Attesting Officer*

*Acting Commissioner of Patents and Trademarks*